US008074569B2

(12) United States Patent
Kucaba et al.

(10) Patent No.: US 8,074,569 B2
(45) Date of Patent: Dec. 13, 2011

(54) ROLLER PAD PRINTER AND METHOD FOR PRINTING

(75) Inventors: Tracy E. Kucaba, South Elgin, IL (US); Kevin B. Sharp, Garden Prairie, IL (US)

(73) Assignee: Illinois Tool Works Inc., Glenview, IL (US)

( * ) Notice: Subject to any disclaimer, the term of this patent is extended or adjusted under 35 U.S.C. 154(b) by 482 days.

(21) Appl. No.: 12/265,051

(22) Filed: Nov. 5, 2008

(65) Prior Publication Data

US 2009/0120311 A1 May 14, 2009

Related U.S. Application Data

(60) Provisional application No. 60/986,900, filed on Nov. 9, 2007.

(51) Int. Cl.
*B41F 17/20* (2006.01)
*B41M 1/40* (2006.01)

(52) U.S. Cl. ..... 101/41; 101/163; 101/492; 101/493

(58) Field of Classification Search ..... 101/41, 101/163, 492, 493; *B41F 17/18, 17/20, 17/30, B41F 17/34*

See application file for complete search history.

(56) References Cited

U.S. PATENT DOCUMENTS 5,335,595 A * 8/1994 Yamashita et al. ..... 101/158
5,715,754 A * 2/1998 Nishibayashi et al. ..... 101/492
5,806,419 A * 9/1998 Adner et al. ..... 101/35

FOREIGN PATENT DOCUMENTS

JP 62275752 A * 11/1987

* cited by examiner

*Primary Examiner* — Leslie J Evanisko
(74) *Attorney, Agent, or Firm* — Levenfeld Pearlstein, LLC

(57) ABSTRACT

A roller pad printer for printing on an associated object includes a frame, a flat cliché operably mounted to the frame for receiving and a resilient roller pad operably mount to the frame for rolling contact, at a first location and in a first direction along the cliché, to receive ink transferred from the cliché. The roller pad is adapted for rolling contact with the object, at a second location and in a second direction, to transfer the ink from the roller pad to the object.

16 Claims, 4 Drawing Sheets

ROLLER PAD PRINTER AND METHOD FOR PRINTING

CROSS-REFERENCE TO RELATED APPLICATION

This application claims the benefit of priority of Provisional U.S. Patent Application Ser. No. 60/986,900, filed Nov. 9, 2007, entitled "Roller Pad Printer".

BACKGROUND OF THE INVENTION

The present invention relates to pad printers. More particularly, the present invention relates to a roller or roll-on pad printing system.

Pad printing systems are used to apply high quality print, e.g. indicia. Pad printing systems use a deformable pad which receives ink, transferred as an image, from a cliché plate. The plate has an etching or engraving of the indicia formed therein. The image is transferred from the pad to the item into which the indicia is applied.

There are two principal types of pad printers: standard pad printers that use a flat printing plate cast called a cliché, and rotary pad printers that use a drum shaped cliché. In the standard pad printer, a flat cliché plate has the image to be printed etched into the plate. Ink is applied to (and wiped from) the cliché, and the pad is brought into contact with, e.g., pressed into, the cliché until the ink is transferred onto the pad. The pad is then brought into contact with the item to transfer the print onto the item. Both the inking motion (transferring ink from the cliché to the pad) and the printing motion (transferring ink or decoration from the pad to the item) are linear motions.

The rotary pad printer uses a drum-shaped cliché to present ink to a synchronized, counter rotating cylindrical roller pad to transfer ink from the cliché to the pad roll. The roller pad is then moved across the item surface to transfer the ink/decoration to the item.

While both of these methods function very well for printing or decorating certain items or types of items, they do have their drawbacks. For example, traditional (linear motion) pad printing is not effective when printing large areas of ink or when printing images that are very long.

The rotary printer is large and can be costly to manufacture and operate, for example, to manufacture the rotating and counter rotating drum arrangements and the drum-shaped cliché. In addition, rotary printers operate using an 'open ink well', which exposes the ink to atmosphere, resulting in more rapid viscosity change due to solvent evaporation, and increased opportunity for ink contamination. Moreover, rotary printers operate on a continuous basis, which is not always a cost effective and efficient manner of operation.

Accordingly, there is a need for a printing system that provides the flexibility of a rotary printer with the ease of use and design of a traditional linear motion pad printer.

SUMMARY OF THE INVENTION

A roller pad printer is configured to print on an associated object and includes a frame, a flat cliché operably mounted to the frame and a resilient roller pad operably mounted to the frame for rolling contact with the cliché.

The printer is especially useful for printing long or large areas on the item or object to be printed. The roller pad engages the clichés at a first location and in a first direction along the cliché, to receive ink transferred from the cliché. The roller pad is adapted for rolling contact with the object, at a second location and in a second direction to transfer the ink from the roller pad to the object. In one embodiment the first and second directions are parallel to each other. The first and second directions can, however, be other than parallel to one another.

The printer includes an ink supply, preferably having an ink cup with a wiper blade on the ink cup to wipe excess ink from the cliché.

In a present printer a carriage roll assembly is configured to laterally move the roller pad between the first and second locations, between the cliché and the object and to maintain the orientation of the roller axis stationary so that the first and second directions are parallel. The assembly can also be configured to rotate the roller axis to change the first and second direction so that they are not parallel to one another.

The printer can include a motor operably connected to the roller pad to rotate the roller pad and control an angular position of the roller pad relative to the cliché or the object. Alternately the roller pad can be an idler roller. The printer can be configured as part of a robotic assembly.

A method of printing includes the steps of inking a flat cliché, engaging a roller pad and the flat cliché against one another, moving linearly in an inking direction, at a first location, one or both of the roller pad and the cliché relative to each other to transfer at least a portion of the ink from the cliché to the roller pad, moving the roller pad transversely to the inking direction to a position for engaging the object at the area to be printed and moving linearly, in a printing direction, one or both of the roller pad and the object relative to the other to transfer at least a portion of the ink from the roller pad onto the object to be printed to print the area.

The method can include moving an ink cup over the cliché to deposit ink on the cliché.

One present method includes the step of indexing the roller pad to control an angular position of the roller pad relative to the cliché. The position of the roller pad can be monitored to control the location of the roller pad relative to an etched portion in the cliché and a location of the roller pad relative to the area to be printed.

The roller pad can be returned to an initial position after transfer of the at least a portion of the ink from the roller pad to the object.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
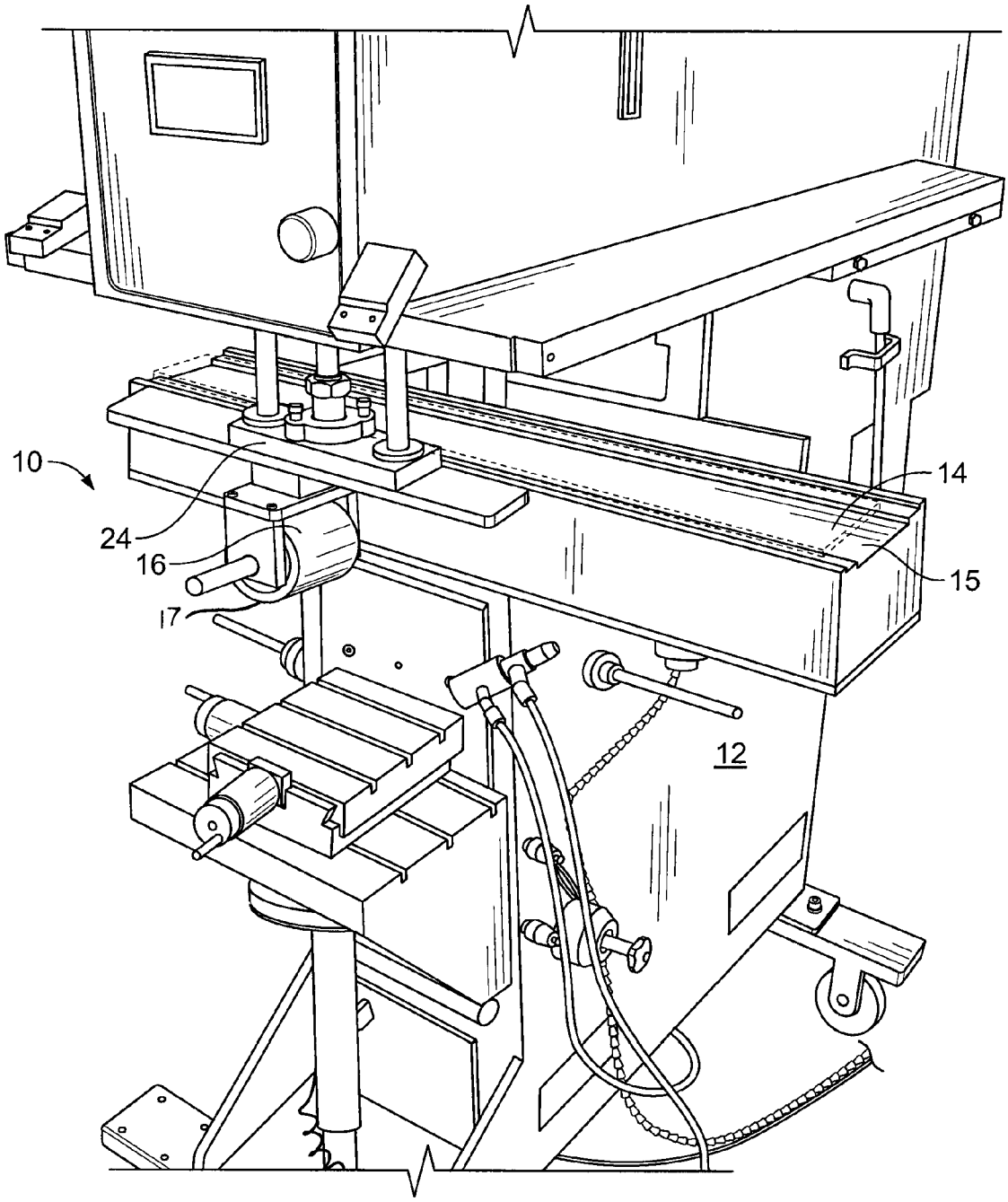
FIG. 1 is a perspective view of the roller pad printer embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Figure 2:
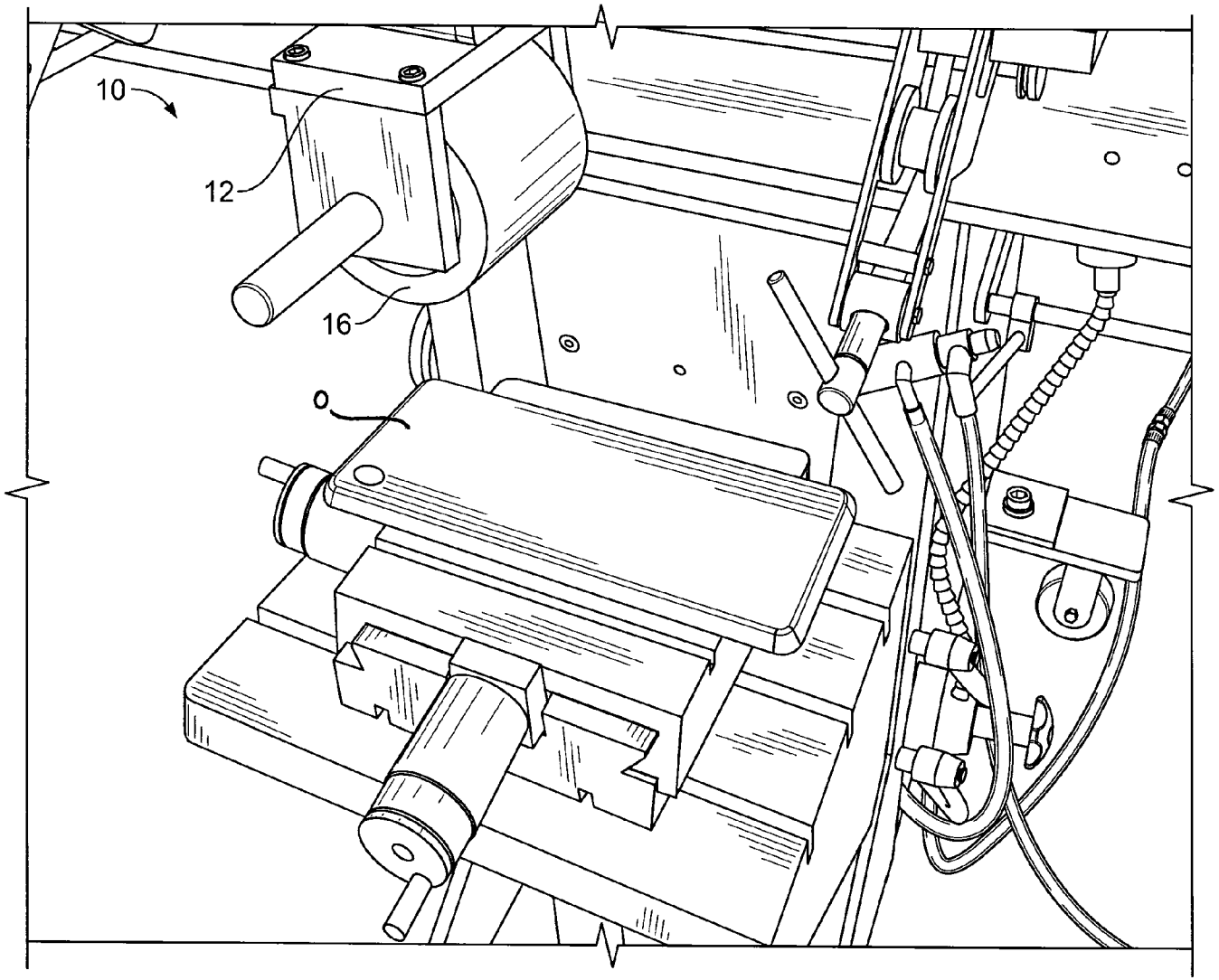
FIG. 2 is a perspective view of the roller pad printer.

Referring now to the figures and briefly to FIGS. 1 and 2, there is shown a roller pad printer 10 embodying the principles of the present invention. The printer 10 is configured to print high quality indicia onto relatively long objects O or to print large (and long) images onto objects O. The printer 10 includes a frame 12 onto which the various components are mounted. A cliché 14 is flat and rests on a platform 15 and a printing roller pad 16 is a cylindrical roll-type pad.

Figure 3:
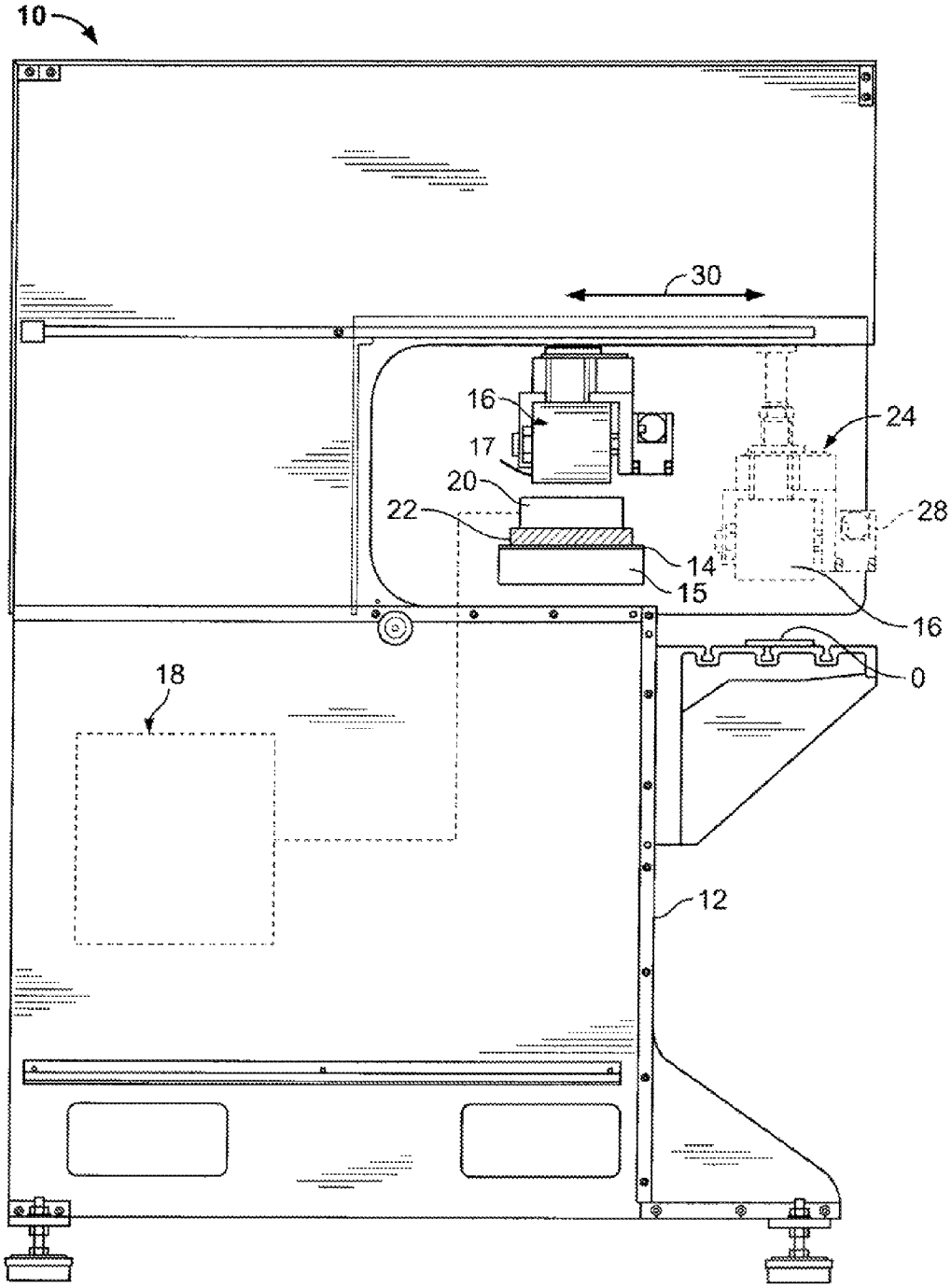
FIG. 3 is a front view of the roller pad printer.

In FIG. 3, the cliché 14 is fed from an ink supply 18. The ink is supplied to the cliché 14 using apparatus and methods that will be recognized by those skilled in the art. In one known configuration, an ink cup 20 is conveyed over the cliché 14 and ink is deposited into the etched regions in the cliché 14. Excess ink is wiped from the cliché 14, typically by a wiper blade 22 that is formed as part of or integral with the ink cup 20. Ink is supplied to the ink cup 20 by the ink supply system 18.

Figure 4:
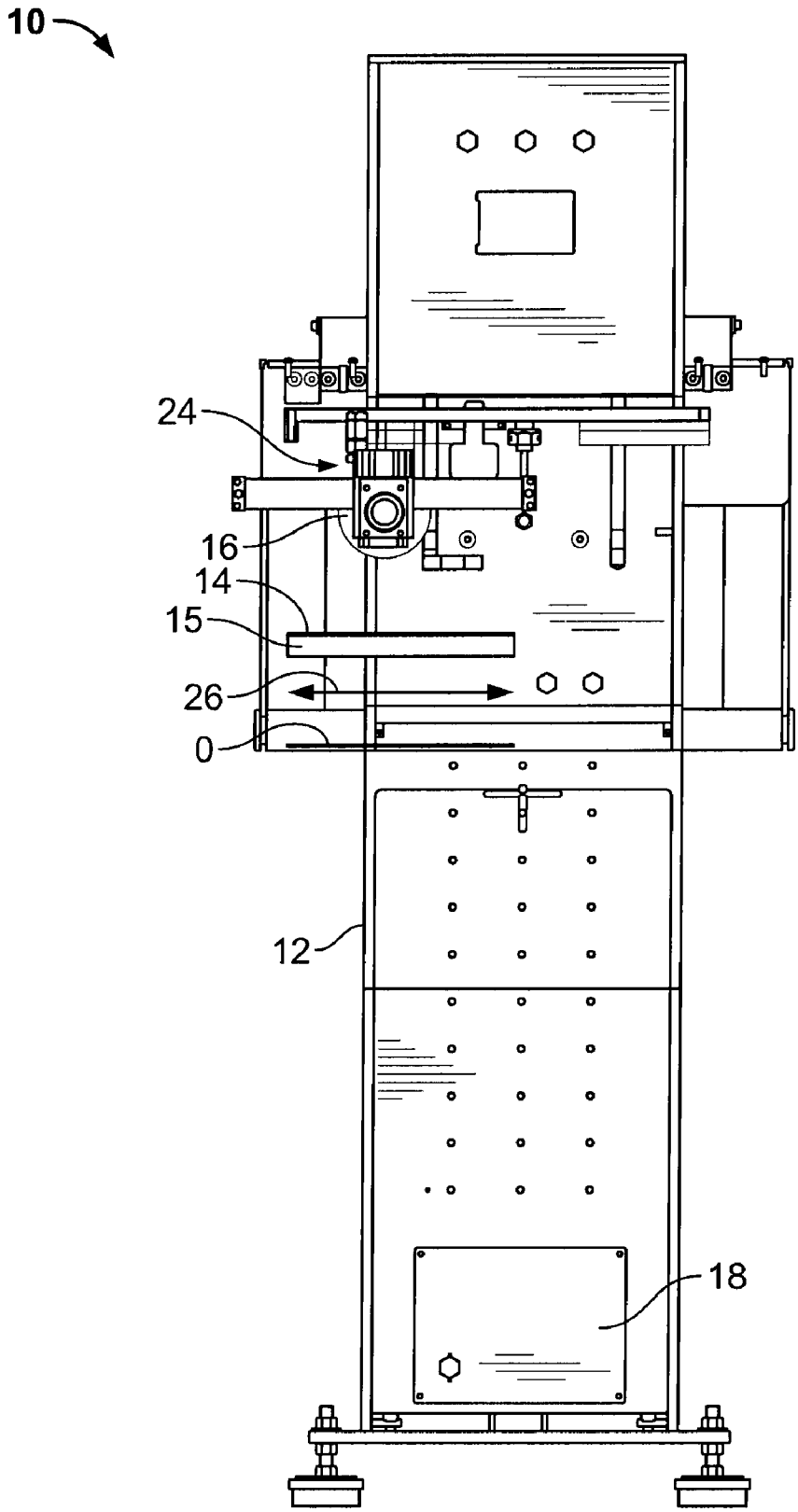
FIG. 4 is a side view of the roller pad printer.

In FIG. 4, the ink is picked up from the cliché 14 and transferred onto the roller pad 16, by compressing the roller pad 16 and the cliché 14 against one another and moving the two relative to one another. In a present printer 10, the roller pad 16 is carried on a carriage 24 (a carriage roll assembly) such that the carriage 24 is moved (as indicated by the arrow at 26), longitudinally along the cliché 14, or rolled across the flat cliché 14 to pick up ink or transfer ink onto the pad of the roller pad 16. It will be appreciated that contact between and the relative motions of the roller pad 16 and the cliché 14 must be carried out in a controlled manner so that the location of the image (ink) transferred onto the pad is accurately controlled for subsequent transfer onto the object O.

The roller pad 16 can be a driven element. In such an arrangement, the drive includes a motor 28 that rotates the roller pad 16 in an indexed manner so as to accurately control the angular position of the roller pad 16 relative to the cliché 14. This type of arrangement can be used, for example, when printing on "relief" type raised surfaces that may have insufficient contact area with the roller pad to effectively rotate the roller pad during print operation. Alternately, the roller pad 16 can be non-driven roller (e.g., an idler roll), and can be rotated by friction (between the roller pad 16 and the cliché 14) and movement of the carriage 24 relative to the stationary cliché 14.

The carriage 24 is then moved transversely (as indicated by the arrow at 30) from over the cliché 14 to a position over the item or object O to be printed/decorated. In FIG. 3, the carriage 24 is shown in phantom in a second position for illustration only; those skilled in the art will appreciate there is only one carriage/roller 24/16 assembly in the machine 10 and which is slidably movable.

The roller pad 16 is then brought into contact with the item O onto which the ink or decoration is to be transferred, and the two are moved relative to one another. Again, in the present printer, the carriage 24 is moved relative to the item O (also as indicated by the arrow at 26) and as such, the pad 17 of the roller pad 16 is rolled across the surface of the item O, and the item O is decorated.

The present system 10 has been found to be advantageous when printing large areas of ink (decoration) or when printing long decorations onto relatively flat items O. The present system 10 allows for these printing scenarios by using a novel combination of traditional linear motion pad printers and the side-to-side printing of rotary pad printers. By using this novel hybrid arrangement, images can be printed on an item from one side to the other side, across the item, rather than the center-out distribution of traditional pad printing.

Importantly, the present roller pad printer 10 allows the use of a flat cliché 14 (akin to traditional pad printing techniques) and in some instances, will allow modification of traditional pad printers (e.g., printing machines) with a roller pad for more flexibility in the types and sizes of decorations that can be printed and with more flexibility in the types and sizes of items onto which printing can be applied. Moreover, the present pad printer 10 can be used to apply printing on a smaller and/or a batch basis rather than on a continuous basis, thus providing significantly more flexibility than known rotary printing systems.

Although the present roller pad 16 is described as being a driven element, as discussed above, the roller pad can be a non-driven or idler roller pad that is rotated by the action of friction between the moving roller pad 16 and relatively stationary cliché 14 or item O. In such an arrangement, it may be desirable to monitor the position of the roller pad 16 (angular as well as linear) to determine/monitor/control the location of the roller pad 16 relative to the decoration etched in the cliché and/or the location of the roller pad relative to the item. The illustrated printer 10 is of the type that uses a non-driven roller pad when printing, but is driven (by the motor 28) to return the roller pad to its initial position each time it is "reset" to begin a new cycle. It has also been found to be desirable to commence each inking and printing cycle with the roller pad 16 in the same angular position so that the ink pattern is transferred onto the same location on the roller pad 16.

It is also anticipated that printer 10 can be used to print cylindrical or round parts, by using a motor driven pad roll, and/or motor driven part fixture to rotate the part under the pad and apply the image. This would be advantageous when printing low volumes of parts that do not justify a fully automated continuous motion style rotary pad printer, or when printing several different sizes and shapes of parts, which are difficult to accommodate in rotary pad printer part transfer systems, but easily accommodated with job specific tooling in traditional pad printing.

It will also be appreciated that although the present printer 10 is described as a traditional printer, the printer, the is the printing function, can be integrated with or within another device, such as a robotic system. For example, the carriage 24 can be integrated into the arm of a robot, and that such modifications, changes, alterations and the like are within the scope and spirit of the present printing system and are to be construed as such.

All patents referred to herein, are incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A roller pad printer for printing on an associated object, comprising:

a frame;

a flat cliché operably mounted to the frame, the cliché adapted to receive ink thereon;

a resilient roller pad operably mounted to the frame for rolling contact, at a first location and in a first direction along the cliché, to receive ink transferred from the cliché, the roller pad adapted for rolling contact with the object, at a second location and in a second direction to transfer the ink from the roller pad to the object, wherein the first and second directions are parallel to one another, and wherein the first and second locations are different and spaced apart from one another in a third direction that is different than the first and second directions.

2. The roller pad printer in accordance with claim 1 including an ink supply.

3. The roller pad printer in accordance with claim 2 wherein the ink supply includes an ink cup.

4. The roller pad printer in accordance with claim 3 wherein the ink cup includes a wiper blade.

5. The roller pad printer in accordance with claim 1 including a carriage roll assembly configured to laterally move the roller pad between the first and second locations, between the cliché and the object.

6. The roller pad printer in accordance with claim 1 including a motor operably connected to the roller pad to rotate the roller pad and control an angular position of the roller pad relative to the cliché or the object.

7. The roller pad printer in accordance with claim 1 wherein the roller pad is an idler roller.

8. A device for transferring print onto an associated object, comprising:

a frame;

an arm operably mounted to the frame;

a flat cliché operably mounted to the frame, the cliché adapted to receive ink thereon;

a resilient roller pad operably mounted to the arm and movable relative to the cliché for rolling contact, at a first location and in a first direction along the cliché, to receive ink transferred from the cliché, the roller pad adapted for rolling contact with the object, at a second location and in a second direction to transfer the ink from the roller pad to the object, wherein the first and second directions are parallel to one another, and wherein the first and second locations are different and spaced apart from one another in a third direction that is different than the first and second directions.

9. The device for transferring print in accordance with claim 8 including an ink supply having an ink cup.

10. The device for transferring print in accordance with claim 8 including a carriage roll assembly configured as part of the arm, the carriage roll assembly configured to laterally move the roller pad between the first and second locations, between the cliché and the object.

11. The device for transferring print in accordance with claim 8 including a motor operably connected to the roller pad to rotate the roller pad and control an angular position of the roller pad relative to the cliché or the object.

12. A method for printing an area on an object, the method comprising the steps of:

inking a flat cliché;

engaging a roller pad and the flat cliché against one another;

moving linearly in an inking direction, at a first location, at least one of the roller pad and the cliché relative to the other such that at least a portion of the ink is transferred from the cliché to the roller pad;

moving the roller pad transversely to the inking direction to a second location for engaging the object at the area to be printed;

moving linearly, in a printing direction, at least one of the roller pad and the object relative to the other, the printing direction being parallel to the inking direction; and transferring at least a portion of the ink from the roller pad onto the object to be printed to print the area, wherein the first and second locations are spaced apart from one another in a third direction that is different than the first and second directions.

13. The method of printing in accordance with claim 12 including the step of moving an ink cup over the cliché to deposit ink on the cliché.

14. The method of printing in accordance with claim 12 including the step of indexing the roller pad to control an angular position of the roller pad relative to the cliché.

15. The method of printing in accordance with claim 12 including the step of monitoring the position of the roller pad to control the location of the roller pad relative to an etched portion in the cliché and a location of the roller pad relative to the area to be printed.

16. The method of printing in accordance with claim 12 including the step of returning the roller pad to an initial position after transfer of the at least a portion of the ink from the roller pad to the object.

* * * * *